United States Patent [19]

Bomhard

[11] 4,426,817

[45] Jan. 24, 1984

[54] DOUBLE-WALLED TANK FOR LOW-TEMPERATURE LIQUIDS

[75] Inventor: Helmut Bomhard, Starnberg, Fed. Rep. of Germany

[73] Assignee: Dyckerhoff & Widmann Aktiengesellschaft, Munich, Fed. Rep. of Germany

[21] Appl. No.: 184,484

[22] Filed: Sep. 5, 1980

[30] Foreign Application Priority Data

Sep. 8, 1979 [DE] Fed. Rep. of Germany ..... 2936420

[51] Int. Cl.[3] ..... E04B 1/66; E04B 1/74

[52] U.S. Cl. ..... 52/262; 52/80; 52/265; 52/408

[58] Field of Search ..... 52/249, 262, 169.11, 52/743, 80, 86, 381, 382, 408; 220/444, 901

[56] References Cited

U.S. PATENT DOCUMENTS

| | | | |
|---|---|---|---|
| 644,259 | 2/1900 | Ostergren | 220/901 X |
| 3,538,661 | 11/1970 | Nelson | 52/249 X |
| 3,562,977 | 2/1971 | Alleaume | 52/249 X |
| 4,014,147 | 3/1977 | Wesch | 52/249 |
| 4,041,722 | 8/1977 | Terlesky et al. | 52/265 |
| 4,069,642 | 1/1978 | Hendriks | 52/224 |
| 4,366,654 | 1/1983 | Bomhard | 52/224 |

*Primary Examiner*—Alfred C. Perham

*Attorney, Agent, or Firm*—Toren, McGeady and Stanger

[57] ABSTRACT

In a double-walled tank for low-temperature liquids, such as liquid gas, an inner tank forming a primary safety casing is enclosed by an outer tank forming a secondary safety casing. The outer tank is constructed of reinforced concrete. A layer of thermal insulation is provided between the inner and outer tanks. The inside surface of the outer tank at least on the side wall and base is covered first by a vapor-tight layer and then by a layer of a liquid-tight thermal insulation material, preferably polyurethane foam.

6 Claims, 5 Drawing Figures

DOUBLE-WALLED TANK FOR LOW-TEMPERATURE LIQUIDS

SUMMARY OF THE INVENTION

The present invention is directed to a double-walled tank for low-temperature liquids, such as a liquid gas, and consists of an inner tank forming a primary safety casing and an outer tank, constructed of reinforced concrete, enclosing the inner tank and forming a secondary safety casing. A layer of thermal insulation is located between the two tanks.

In a double-walled tank of this type, the inner tank constitutes the actual storage container. Thus, the inner tank forms the primary safety casing while the outer tank acts as the secondary safety casing. If there is any leakage from the inner tank, the low-temperature liquid is prevented from direct escape into the environment by the outer tank.

If there is any leakage from the inner tank, the cold liquid escapes to the outer tank passing through the layer of thermal insulation between the two tanks. Because of the considerable temperature difference between the cold liquid and the outer tank which is substantially at the ambient temperature, the cold liquid evaporates very quickly. Consequently, the outer tank is cooled very rapidly and experiences cold shock. Even if safety valves are provided in the outer tank for such a rapid evaporation accident, and other safety precautions are taken, it is desirable not to overload these safety means.

Therefore, it is the primary object of the present invention, to cover the inside surface of the outer tank with a continuous arrangement of layers at least in the area of the side wall and the base of the tank. The arrangement of layers consists of a vapor-tight layer in contact with the inner surface of the outer tank with a layer of liquid-tight thermal insulation material, preferably polyurethane foam, deposited on the vapor-tight layer. Advantageously, the vapor-tight layer is formed of metal, for instance steel which is ductile at low temperatures. The polyurethane foam layer is advantageously sprayed on the vapor-tight layer in layers but without any joints.

Below the base of the inner tank, load transmitting spacers are embedded into the polyurethane foam layer. A load distributing reinforced concrete slab is placed over the spacers. The concrete slab is reinforced with members which are ductile at low temperatures. A layer of thermal insulation is placed over the slab and consists of a pressure-tight material, for instance, foam glass. Preferably, the load-transmitting spacers are made of a thermal insulation material.

The basic concept of the invention is a laminated construction of the outer tank including a reinforced concrete jacket, a vapor-tight layer on the inside of the jacket with a polyurethane foam inner layer completing the inner portion of the lamination. While the vapor-tight layer is intended only to prevent moisture from passing inwardly into the double-walled tank from the exterior, so that wetting of the thermal insulation which would then become unserviceable, is prevented, the polyurethane foam layer has two thermal insulation functions in addition to its sealing functions. One of its functions is to limit the rate of evaporation so that it does not exact excessive demands on the safety equipment and the other is to afford protection of the metal vapor-tight layer and the reinforced concrete jacket from cold shock.

The function of the outer tank as a secondary safety casing is fully effective only if both the vapor-tight layer and the inner polyurethane foam layer contain no gaps in the base area of the inner tank. The load of the inner tank must be continuously supported by the arrangement of layers and transmitted through the base of the outer tank to the foundation. In accordance with the present invention, this load transmission is effected by load-bearing spacers which may be formed of thermal insulation material and embedded in the manner of a reinforcement, in the polyurethane foam layer. The loading from the inner tank is uniformly distributed over the spacers by a flexurally stiff reinforced concrete slab extending over the spacers. The reinforcing members in the slab are formed of a material which is ductile at low temperatures. The spacers transmit the inner tank loading to the foundation via the outer tank base. It is particularly advantageous that this construction is not limited to flat base surfaces, rather it is suitable for surfaces of any shape, such as curved surfaces, and having a high admissible base pressure.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

DETAIL DESCRIPTION OF THE INVENTION

Figure 1:
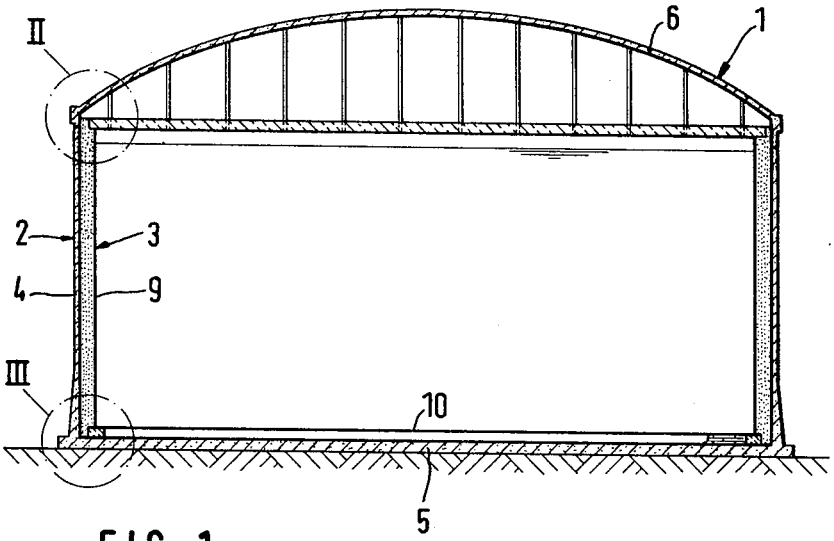
FIG. 1 is a vertical sectional view through a double-walled tank embodying the present invention.
Figure 2:
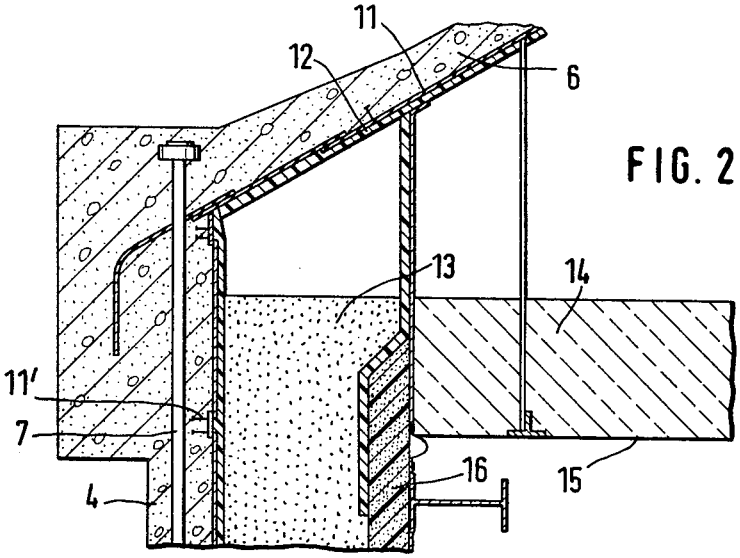
FIG. 2 is an enlarged partial cross-sectional view of a portion of the top area of the tank indicated at II in FIG. 1.
Figure 3:
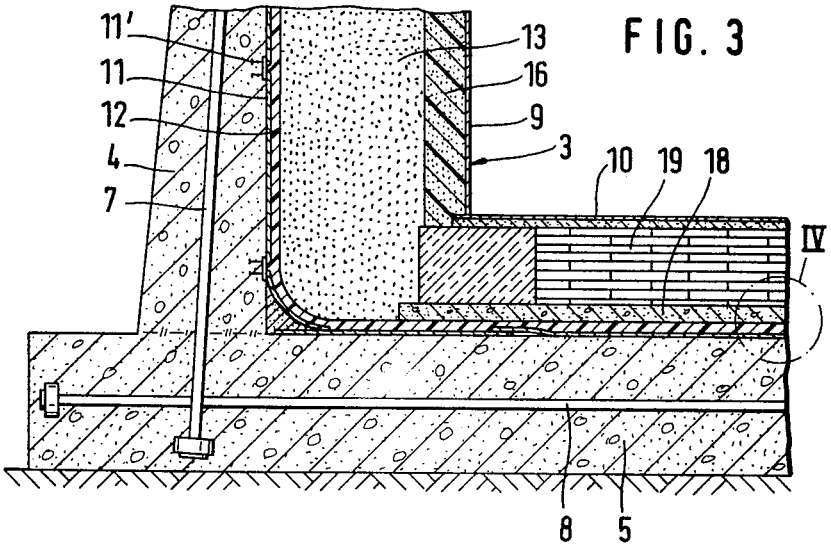
FIG. 3 is an enlarged partial cross-sectional view through a portion of the base area of the tank indicated at III in FIG. 1.

In FIG. 1 a cylindrical double-walled tank 1 is illustrated including an outer tank 2 and an inner tank 3. Outer tank 2 has an upwardly extending cylindrical side wall 4, a generally horizontally extending base 5, and a dome-shaped roof shell 6. The parts of the outer tank are constructed of reinforced concrete. FIGS. 2 and 3 illustrate reinforcing members 7, 8 for prestressing the side wall 4 and the base 5. Inner tank 3 is formed of metal and has an upwardly extending side wall 9 and a generally horizontally extending base 10. A metal liner 11 forms a vapor-tight layer on the inside surface of the outer tank. The metal liner 11 is rigidly connected to the cylindrical side wall 4 by bolts 11'. A thermal insulation layer 12 is deposited on the inner surface of the liner 11 forming an insulation liner. The thermal insulation layer 12 is formed of polyurethane foam which is sprayed on in layers without any joints. The arrangement of the layers 11, 12 extend over the entire inside surface of the outer tank in the example illustrated, that is, not only the inner surface of the side wall 4 and the base 5 but also the inner surface of the roof shell 6, note FIGS. 2 and 3.

The space between the outer tank 2 and the inner tank 3 is filled with a thermal insulation material 13, such as perlite. Another thermal insulation material 14 is provided below the roof shell 6 in the form of a suspended ceiling 15. An elastic mat 16 is located between the inner boundary of the thermal insulation material 13 and the outer surface of the inner tank 3.

Figure 4:
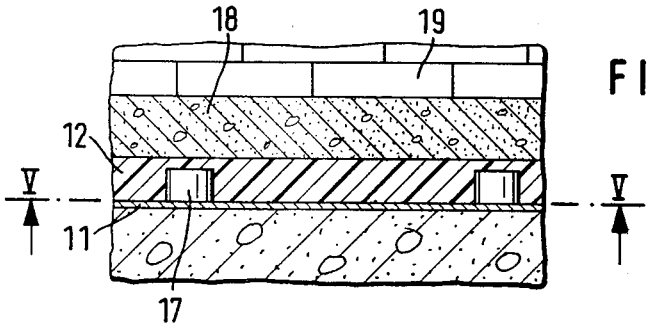
FIG. 4 is an enlarged partial cross-sectional view through the base of the tank indicated at IV in FIG. 3.
Figure 5:
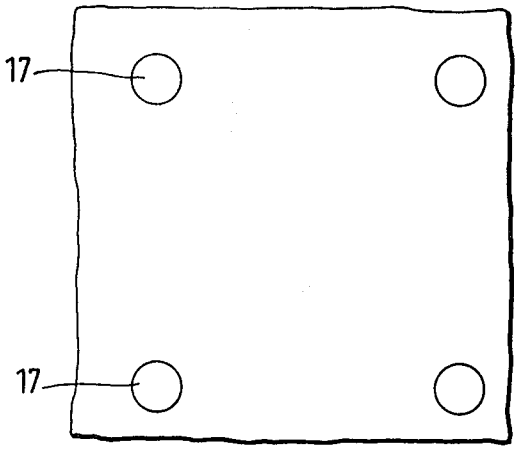
FIG. 5 is a horizontal sectional view taken along the line V—V in FIG. 4.

Load-bearing spacers 17 are incorporated into the polyurethane foam liner below the base 10 of the inner tank and provide reinforcement for the base. As can be seen in FIG. 5, the spacers 17 are arranged in a regular pattern. In FIG. 4 it can be noted that the bottoms of the spacers 17 rest on the upper surface of the metal liner 11. Superimposed on the upper ends of the spacers 17 is a load-distributing reinforced concrete slab 18. The reinforcing members used in the slab 18 are ductile at low temperatures. A pressure-tight thermal insulation layer 19 is located between the slab 18 and the base 10 of the inner tank 3.

Preferably, the spacers 17 are constructed of a thermal insulation material, such as plastics, wood or light weight concrete. These spacers 17 are foamed into the polyurethane foam and, accordingly, are sealingly connected to the layer 12. As a result, there are no problems in respect to sealing or affording thermal insulation in the base area of the tank.

While specific embodiments of the invention have been shown and described in detail to illustrate the application of the inventive principles, it will be understood that the invention may be embodied otherwise without departing from such principles.

What is claimed is:

1. A double-walled tank for low-temperature liquids, such as liquid gas, comprising an inner tank forming a primary safety casing and an outer tank enclosing said inner tank and forming a secondary safety casing, said outer tank being constructed of reinforced concrete, a ceiling extending across the upper end of said outer rank and forming a closure for the upper end of the double-walled tank, a layer of thermal insulation located between said inner and outer tanks, a vapor-tight layer covering the inside surface of said outer tank, wherein the improvement comprises that said outer tank comprises a generally horizontally arranged base and an upwardly extending side wall extending between said base and said ceiling, said vapor-tight layer being in direct surface contact with the entire inside surface of said outer tank including said side walls and said base, and said layer of thermal insulation comprising a liquid-tight first layer of polyurethane foam disposed in surface contact with and completely covering the inside surfaces of said vapor-tight layer and forming in combination with said vapor-tight layer a continuous and complete covering on the inside surfaces of said side wall and said base of said outer tank and said first layer of polyurethane foam being joint free throughout its extent in contact with said vapor-tight layer.

2. A double-walled tank, as set forth in claim 1, wherein said vapor-tight layer being formed of a metal liner.

3. A double-walled tank, as set forth in claim 2, wherein said metal liner being formed of steel which is ductile at low temperatures.

4. A double-walled tank, as set forth in any of of claims 1, 2 or 3, wherein said inner tank comprising a base spaced upwardly from said base of said outer tank and a side wall extending upwardly from said base, load transmitting spacers embedded in said first layer of polyurethane foam between the base of said inner tank and the base of said outer tank, a load-distributing reinforced concrete slab located above said spacers below said base of said inner tank, said slab having reinforcing members which are ductile at low temperatures, and a pressure-tight thermal insulation layer located above said concrete slab and below said base of said inner tank.

5. A double-walled tank, as set forth in claim 4, wherein said pressure-tight thermal insulation layer comprising a foam glass.

6. A double-walled tank, as set forth in claim 4, wherein said load-transmitting spacers being formed of a thermal insulation material.

* * * * *